US006830293B2

(12) United States Patent
Vanderminden

(10) Patent No.: US 6,830,293 B2
(45) Date of Patent: Dec. 14, 2004

(54) SEAT PAD FOR OUTDOOR FURNITURE

(75) Inventor: William M. Vanderminden, Granville, NY (US)

(73) Assignee: Telescope Casual Furniture, Inc., Granville, NY (US)

( * ) Notice: Subject to any disclaimer, the term of this patent is extended or adjusted under 35 U.S.C. 154(b) by 91 days.

(21) Appl. No.: 09/896,257

(22) Filed: Jun. 29, 2001

(65) Prior Publication Data

US 2003/0001416 A1 Jan. 2, 2003

(51) Int. Cl.[7] ..... A47C 31/00
(52) U.S. Cl. ..... 297/219.1; 297/226; 297/440.11
(58) Field of Search ..... 297/219.1, 228.13, 297/228, 229, 228.12, 226, 452.1, 452.11, 452.16, 452.12, DIG. 6, 440.11

(56) References Cited

U.S. PATENT DOCUMENTS 2,738,835 A * 3/1956 Eames
3,024,068 A * 3/1962 Eames
3,379,474 A * 4/1968 Schwartz, Jr.
3,671,984 A * 6/1972 Ambrose
4,432,521 A * 2/1984 Douglas
5,190,350 A * 3/1993 Hwang et al. ..... 297/380
5,297,848 A * 3/1994 Grinnell
5,318,348 A * 6/1994 Hess
5,367,714 A * 11/1994 Hines et al.
5,403,066 A * 4/1995 Drum
5,664,844 A * 9/1997 Greene
5,803,539 A * 9/1998 Dewar et al. ..... 297/228.12

FOREIGN PATENT DOCUMENTS

GB 2225938 * 6/1990

* cited by examiner

*Primary Examiner*—Peter M. Cuomo
*Assistant Examiner*—Stephen Vu
(74) *Attorney, Agent, or Firm*—Francis C. Hand; Carella, Byrne, Bain et al.

(57) ABSTRACT

The seat pad as a free-standing structure which provides a seat and back. A pair of contoured rigid bars are enclosed within opposite sides of a fabric sleeve to shape the sleeve into a seat and back. In addition, a web of densified padding is disposed between the bars and within the fabric sleeve to bias the rigid bars outwardly of each other to flatten the sleeve. Rows of stitching are employed to secure the padding to the fabric to provide not only reinforcement but also a pleasing aesthetic appearance to the seat pad.

16 Claims, 2 Drawing Sheets

SEAT PAD FOR OUTDOOR FURNITURE

This invention relates to a seat pad for outdoor furniture.

As is known, outdoor furniture such as chairs, settees, gliders and the like have been constructed to be of a cushion type or a non-cushion type. For example, outdoor chairs are known wherein a fabric or webbing is placed across a metal or wood frame in order to provide a seat and back surface to directly receive an occupant. Such constructions are of the non-cushion type and are designed with a particular seat geometry so that an occupant is seated comfortably.

Similar chairs also have been used with cushions to receive an occupant. Typically, the cushions are relatively thick and change the seating geometry of a chair by raising the level of the seat surface as well as changing the surface at which the back of the occupant is supported. Thus, these chairs are designed to compensate for the changes in geometry brought about by the cushions.

It is an object of this invention to provide a seat pad for a chair of the non-cushioned type that does not change the seating geometry of the chair.

It is another object of the invention to provide a seat pad for outdoor furniture of relatively thin construction.

It is another object of the invention to provide a contoured seat pad for a chair of relatively thin and generally rigid construction.

It is another object of the invention to provide a free-standing seat pad which is contoured to provide seat and back support surfaces.

Briefly, the invention is directed to a seat pad for outdoor furniture which is comprised of a pair of parallel spaced apart discrete bars, a fabric sleeve disposed over the bars and padding disposed in the sleeve between the bars to bias the bars laterally outwardly from each other and to stretch the sleeve into a flattened shape.

Each bar is of rigid stock material, such as aluminum, and is typically of rectangular cross section. In addition, each bar is contoured to complement the shape of the piece of furniture on which the pad is used. For example, each bar is formed with a horizontally disposed section and a vertically disposed section such that the fabric sleeve defines a flattened seat and a flattened back. Also, each of the horizontal and vertical sections of a bar may be contoured with a curved end and a rounded transition section may be disposed between the horizontal and vertical sections of the bar.

The seat pad is made as thin as possible to conform to a chair so as not to change the seating geometry of the chair. In this respect, the padding is made slightly thicker than the thickness of the rigid bars and is compressible to a slightly smaller thickness when seated upon it. Typically, the padding material is relatively dense, such as a densified polyester, in order to maintain the shape of the seat pad.

The seat pad further includes a plurality of rows of stitching across the sleeve in order to secure the front face of the sleeve to the back face as well as to the padding therebetween to stiffen the sleeve. The stitching is particularly located at the top area of the flattened back of the sleeve, the front area of the flattened seat of the sleeve and the transition area between the back and seat of the pad in order to aid the pad in conforming to the bends of a chair, particularly in the transition zone between the seat and back of a chair. The stitching also provides an aesthetic appearance to the seat pad.

The seat pad can be easily and quickly installed on a chair and secured in place using a single strap that, for example, envelopes the back of the chair. The strap also serves to hold the pad in place so that the pad conforms to and follows the contour of the chair. In a similar manner, the pad may be easily and quickly removed from a chair when desired.

These and other objects and advantages of the invention will become more apparent from the following detail description taken in conjunction with the accompanying drawing wherein.

Figure 1:
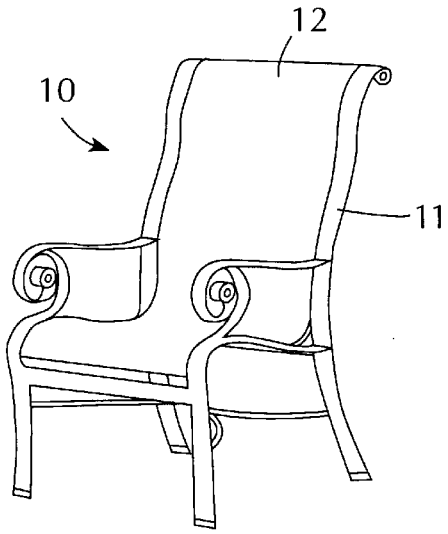
FIG. 1 illustrates a perspective view of an outdoor chair of non-cusion type.

Referring to FIG. 1, the chair 10 is constructed for use as a non-cushion type chair and is provided in known manner with a frame 11, for example of aluminum, and a web 12 of fabric secured to and across frame 11 to define a seat and a back.

Figure 2:
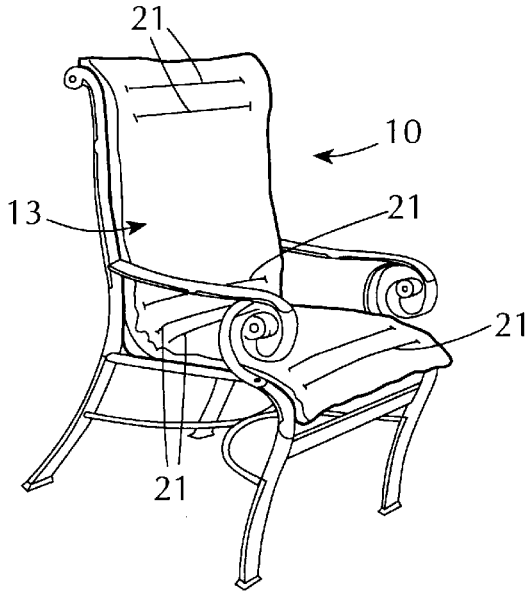
FIG. 2 illustrates the chair of FIG. 1 with a seat pad thereon in accordance with the invention.

Referring to FIG. 2, wherein like reference characters indicate like parts as above, a seat pad 13 is placed on the chair 10 to enhance the comfort of a seated occupant.

Figure 5:
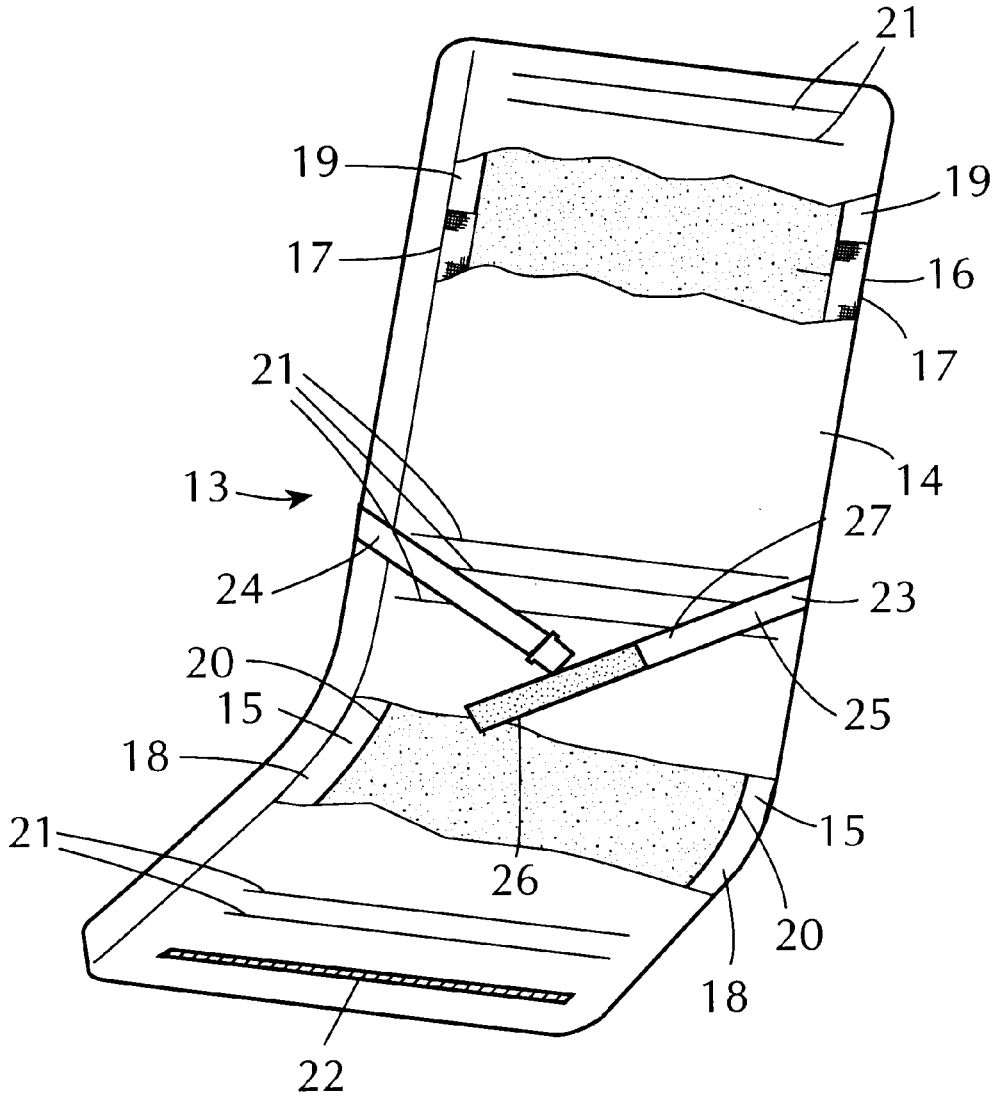
FIG. 5 illustrates a perspective back view of the pad of FIG. 2.

Referring to FIG. 5, the seat pad 13 is formed of a sleeve 14 of fabric material, a pair of discrete rigid bars 15 disposed on and in opposite sides of the sleeve 14 and padding 16 within the sleeve 14 and between the bars 15.

The sleeve 14 is of any material suitable for use on outdoor furniture and is initially provided with an open lower end and a closed upper end. In addition, a strip of material 17 is stitched or sewn at each of two diametrically opposite internal sides of the sleeve 14 in order to define a pair of elongated pockets, each of which receives a rigid bar 15.

Each bar 15 is made of a rigid stock material, such as aluminum, and is of flattened cross-section. For example, each bar 15 is of a width of ¾ inch and a thickness of 5/16 inch. Further, each bar 15 is contoured to have a horizontally disposed section 18 and a vertically disposed section 19. Each section 18, 19 is also contoured to have a curved end in order to complement the shape of the chair 10. Each bar 15 also has an intermediate transition section 20 which is curved to match with the contour of chair 10 between the seat and back thereof.

The padding 16 is made of a densified material, such as a densified polyester, that is relatively dense to maintain the shape of the sleeve 14. The padding 16 may be in the form of a flat sheet or web of material and is of a width to fit between the two rigid bars 15. In addition, the padding means 16 has a sufficient resiliency to bias the rigid bars 15 laterally outwardly from each other in order to stretch the sleeve 14 into a flattened shape to define a flattened seat and a flattened back.

Referring to FIG. 2, the seat pad 13 also includes a plurality of rows 21 of stitching to secure the front face of a sleeve 14 to the back face of the sleeve 14 as well as to the padding means 16 therebetween in order to stiffen the sleeve 14. The rows 21 of stitching are also placed to reinforce the seat pad 13 at the ends where the seat pad 13 is contoured to match the contour of the chair 10 as well as to provide an aesthetic appearance. Rows 21 of stitching are also provided in the transition section between the front and back of the seat pad 13 for similar purposes. As illustrated, a pair of rows 21 of stitching are disposed across a top area of the flattened back of the sleeve 14, three rows of stitching 21 are provided across a bottom area of the flattened back and a pair of rows of stitching are disposed across a front area of the flattened seat of the sleeve 14.

In order to assemble the seat pad 13, the padding 16 is slid through the open end of the sleeve 14 to completely fill the sleeve 14. Next, a closure means, such as a zipper 22, disposed at the open end of the sleeve 14 is manipulated to close the sleeve 14. The pad is then sewed so that rows of stitching 21 are made to secure the padding 16 in place within the sleeve 14 and to further rigidify the seat pad 13 where the rows of stitching 21 are placed. The pad may then be stored until such time as it is necessary to insert the bars. For example, several pads may be stuffed, sewn and stored. Depending on the shape of the chair for which a seat pad is intended, the proper pair of bars for that chair is subsequently selected and inserted into the sleeve 14 to complete the assembly process.

In order to complete the assembly process, the sleeve 14 is reopened at the bottom and a rigid bar 15 is slid through the open end of the sleeve 14 into each pocket formed on either side of the sleeve 14 by the strips 17. The bars 15 thus shape the sleeve 14 into a horizontally disposed seat and a vertically disposed back.

After fabrication, the seat pad 13 takes on a free-standing shape. That is to say, the rigid bars 15 define a seat and back while the padding 16 biases the bars 15 outwardly of each other so as to flatten the sleeve 14. As such, the free-standing seat pad 13 may be readily placed on a chair as shown in FIG. 1 or may be stored. Several such pads 13 may be stacked for storage purposes and/or transportation purposes.

Referring to FIG. 5, the back of the seat pad 13 is provided with a strap 23 which is secured to the sleeve 14 in an integral manner. The strap 23 is made, for example, of a pair of strips 24, 25, each of which is stitched at one end to the sleeve 14. In addition, one strip 24 is provided with a buckle 26 while the other strip 25 is provided with a layer of self-adhering material 27, such as a Velcro brand strip, for looping through the buckle 26 and for securement to itself.

After the seat pad 13 has been placed on the chair 10, the strap 23 is manipulated so that the strips 24, 25 envelope the back of the chair 10 to secure the seat pad 13 in place.

The seat pad 13 has a thickness when free-standing of approximately 1 ¾" due to the thickness of the padding 16 and the double thickness of the sleeve 14. When a person sits on the pad 13, the pad 13 is compressed to a lesser thickness without changing the seating geometry of the chair 10. That is to say, the relative thinness of the seat pad 13 does not raise the occupant vertically any significant distance and does not position the back of the occupant away from the back of the chair 10. Thus, the seat pad may be used with chairs that are designed to be of the non-cushion type.

The seat pad 13 may be purchased with a chair 10 or may be sold separately for use on previously purchased chairs of the non-cushioned type.

Figure 3:
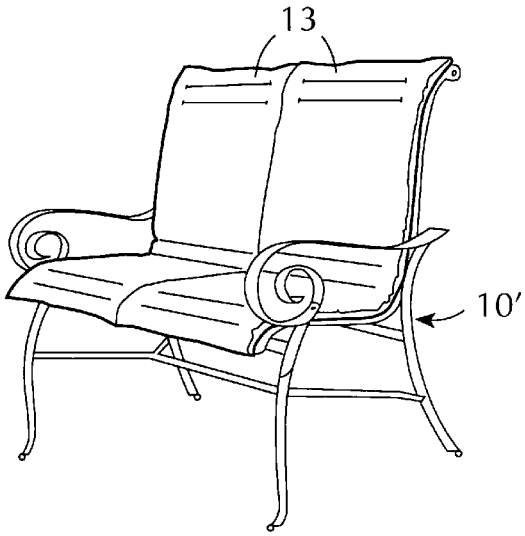
FIG. 3 illustrates a perspective view of a two seat settee employing a pair of seat pads in accordance with the invention.

Referring to FIG. 3, a pair of seat pads 13 may be employed on a two seat settee 10'.

Figure 4:
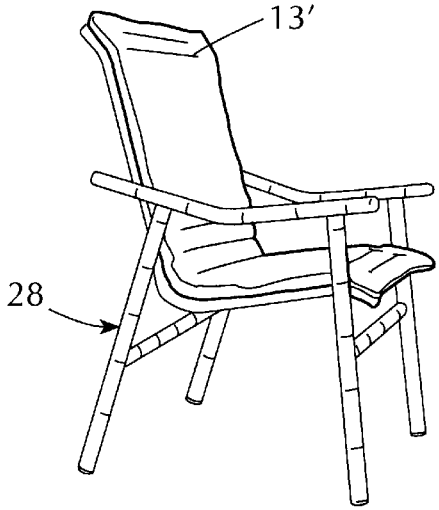
FIG. 4 illustrates a perspective view of a seat pad in accordance with the invention on a chair of different contour from that of FIG. 1.

Referring to FIG. 4, where a chair 28 has a different contour from that as shown in FIG. 1, the seat pad 13' is provided with rigid bars (not shown) which are contoured to the shape of the chair 28. For example, the ends of the rigid bars may have a flatter curvature for the chair shown in FIG. 4 as compared with the chair of FIG. 2.

The seat pads 13 may be provided in various colors and patterns so that a user may select different colors and/or patterns to change the aesthetic appearance of a chair.

The invention thus provides a seat pad of relatively thin construction which can be used without changing the geometry of a chair or the like. Further, the invention provides a seat pad which is a free-standing structure that can be readily handled for placement on a chair to provide a cushioned seat and back as well as for storage.

What is claimed is:

1. A seat pad for outdoor furniture comprising a pair of parallel spaced apart discrete bars, each said bar having a horizontally disposed section and a vertically disposed section;

a fabric sleeve disposed over said bars; and padding disposed in said sleeve and between said bars to bias said bars laterally outwardly from each other and to stretch said sleeve into a flattened shape to define a flattened seat and a flattened back.

2. A seat pad as set forth in claim 1 wherein said padding includes at least one sheet of resilient relatively dense material disposed between said bars.

3. A seat pad as set forth in claim 2 which further comprises a plurality of rows of stitching securing a front face of said sleeve to a back face of said sleeve and to said padding therebetween to stiffen said sleeve.

4. A seat pad as set forth in claim 3 wherein said rows of stitching includes a pair of said rows across a top area of said flattened back of said sleeve, three of said rows across a bottom area of said flattened back and a pair of said rows across a front area of said flattened seat of said sleeve.

5. A seat pad as set forth in claim 1 wherein said sleeve is made of a woven fabric.

6. A seat pad as set forth in claim 1 which further comprises a strap integral with said sleeve for securing the seat pad to a chair.

7. A seat pad as set forth in claim 6 wherein said strap includes a pair of strips, each secured at one end to said sleeve, a buckle on one end of one strip and a layer of self adhering material on one end of the other strip for looping through said buckle.

8. A seat pad as set forth in claim 1 wherein said sleeve includes a pair of longitudinally extending pockets, each said pocket receiving a respective one of said bars.

9. A seat pad as set forth in claim 1 wherein each section of each said bar is contoured with a curved end.

10. A seat pad for outdoor furniture comprising a sleeve of fabric material;

a pair of discrete contoured rigid bars disposed on and in opposite sides of said sleeve, each said bar having a horizontally disposed section and a vertically disposed section to shape said sleeve to define a seat and a back; and resilient padding disposed in said sleeve and between said bars to bias said bars laterally outwardly from each other and to stretch said sleeve into a flattened shape to define a flattened seat and a flattened back.

11. A seat pad as set forth in claim 10 wherein said padding includes at least one web of densified material disposed between said bars.

12. A seat pad as set forth in claim 11 which further comprises a plurality of rows of stitching securing a front face of said sleeve to a back face of said sleeve and to said padding therebetween to stiffen said sleeve.

13. A seat pad as set forth in claim 10 which further comprises a strap integral with said sleeve for securing the seat pad to a chair.

14. A seat pad as set forth in claim 13 wherein said strap includes a pair of strips, each secured at one end to said sleeve, a buckle on one end of one strip and a layer of self adhering material on one end of the other strip for looping through said buckle.

15. A seat pad as set forth in claim 10 wherein said sleeve includes a pair of longitudinally disposed strips at opposite sides thereof to define longitudinally extending pockets, each said pocket receiving a respective one of said bars.

16. A seat pad as set forth in claim 10 wherein each section of each said bar is contoured with a curved end.

* * * * *